US012760495B2

(12) United States Patent
Brocato

(10) Patent No.: US 12,760,495 B2
(45) Date of Patent: Oct. 13, 2026

(54) GPS-BASED TRENCH EXCAVATION GUIDANCE DEVICE AND RELATED METHODS

(71) Applicant: Brocato Construction Company Inc., Batesville, MS (US)

(72) Inventor: Chris Brocato, Batesville, MS (US)

(73) Assignee: Brocato Construction Company Inc., Batesville, MS (US)

( * ) Notice: Subject to any disclaimer, the term of this patent is extended or adjusted under 35 U.S.C. 154(b) by 118 days.

(21) Appl. No.: 18/531,580

(22) Filed: Dec. 6, 2023

(65) Prior Publication Data

US 2025/0188705 A1 Jun. 12, 2025

(51) Int. Cl.
*E02F 5/14* (2006.01)
*E02F 9/20* (2006.01)

(52) U.S. Cl.
CPC ..... *E02F 5/145* (2013.01); *E02F 9/2045* (2013.01)

(58) Field of Classification Search
CPC ..... E02F 5/145; E02F 9/2045
See application file for complete search history.

(56) References Cited

U.S. PATENT DOCUMENTS 6,954,999 B1 * 10/2005 Richardson ..... G05D 1/0278 701/50
2014/0297343 A1 * 10/2014 Tucker ..... G01S 13/885 342/22
2023/0031524 A1 * 2/2023 Ready-Campbell .... E02F 9/205
2023/0134855 A1 * 5/2023 Hodel ..... E02F 9/2045 701/50

* cited by examiner

*Primary Examiner* — Anne Marie Antonucci
*Assistant Examiner* — Jewel A Kuntz
(74) *Attorney, Agent, or Firm* — Capitol City TechLaw, PLLC; Samuel P Burkholder

(57) ABSTRACT

A device and method for maintaining the excavation of an excavation site along a predefined path are disclosed. The device includes positioning system receivers, control units, storage units, user interfaces, and direction guidance displays. The control unit determines if positioning coordinates deviate from a predefined path and generates a path correction signal for display. The method involves designating start and end points, acquiring their positioning coordinates, inputting these into an excavation guidance device, and determining the excavation path. Excavation begins at the start point, with the guidance device providing path correction instructions to ensure the excavation follows the predefined path.

21 Claims, 4 Drawing Sheets

GPS-BASED TRENCH EXCAVATION GUIDANCE DEVICE AND RELATED METHODS

FIELD OF THE INVENTION

The invention pertains to a device and method for maintaining the excavation of a trench along a predetermined path using GPS technology.

BACKGROUND

The need to excavate long trenches to bury various utility conduits or pipes is well known. Presently the services of a licensed surveyor are required to determine the beginning and end points of a trench and mark them appropriately. Many times, during the excavation of a long trench the surveyor's markings of the trench path are obscured or erased over time which can require re-marking of the trench path by the surveyor at increased cost. Additionally, with deep long trench paths, it is possible to not be able to see either of the beginning or end points from inside the trench making directional awareness next to impossible.

There is a need for a device and method to determine where the trench path lies so that a trench can be properly excavated, and conduit can be placed according to the predetermined trench path.

SUMMARY

In accordance with embodiments, a device is provided for maintaining the excavation of an excavation site such as a trench for conduit along a predefined path. The device comprises one or more positioning system receivers, control units, storage units, user interfaces, and direction guidance displays. The control unit determines whether positioning coordinates received from the positioning system receiver deviate from a predefined path and generates a path correction signal for displaying on the direction guidance display. The device can receive the positioning coordinates of the start point and the end point of the predefined path through the user interface, and store them in the storage unit. The control unit can be implemented by one or more computing units, which recognize the information inputted through the user interface, received from the positioning system receiver and the storage unit, perform the operation of determining the variance between the predefined path and the current location of the device, and output a position correction signal to the direction guidance display. The positioning system receiver can be a high-precision positioning board which acquires signals from one or more satellite positioning systems, along with accuracy enhancement data, to provide a high level of positional accuracy.

In accordance with other embodiments, a method is provided for excavating an excavation path for conduit. The method involves designating a start point and an end point, acquiring the positioning coordinates of these points, inputting the positioning coordinates into an excavation guidance device, and determining the positioning path of the excavation from the start point to the end point with the excavation guidance device. The excavation begins at the start point, with the excavation guidance device positioned in the excavation site. The positioning coordinates of the excavation guidance device in the excavation site are acquired, excavation path correction instructions are received from the excavation guidance device, the excavation of the excavation site is modified to follow along the positioning path of the excavation, and excavation continues along the positioning path of the excavation. This process is repeated until the end point is reached.

The excavation guidance device can comprise a positioning system receiver, a control unit, a storage unit, a user interface, and a direction guidance display. The control unit determines whether positioning coordinates received from the positioning system receiver deviate from a predefined path and generates a path correction signal for displaying on the direction guidance display. The excavation guidance device can receive the positioning coordinates of the start point and the end point of the predefined path through the user interface, and store them in the storage unit. The control unit can be implemented by one or more computing units, which recognize the information inputted through the user interface, received from the positioning system receiver and the storage unit, perform the operation of determining the variance between the predefined path and the current location of the excavation guidance device, and output a position correction signal to the direction guidance display. The positioning system receiver can be a high-precision positioning board which acquires signals from one or more satellite positioning systems, along with accuracy enhancement data, to provide a high level of positional accuracy.

This Summary is provided to introduce a selection of concepts in a simplified form that is further described below in the Detailed Description. This Summary is not intended to identify key features or essential features of the claimed subject matter, nor is it intended to be used to limit the scope of the claimed subject matter.

Additional features will be set forth in the description that follows, and in part will be apparent from the description, or may be learned by practice of what is described.

BRIEF DESCRIPTION OF THE DRAWINGS

In order to describe the manner in which the above-recited and other advantages and features may be obtained, a more particular description is provided below and will be rendered by reference to specific embodiments thereof which are illustrated in the appended drawings. Understanding that these drawings depict only typical embodiments and are not, therefore, to be limiting of its scope, implementations will be described and explained with additional specificity and detail with the accompanying drawings.

Figure 1:
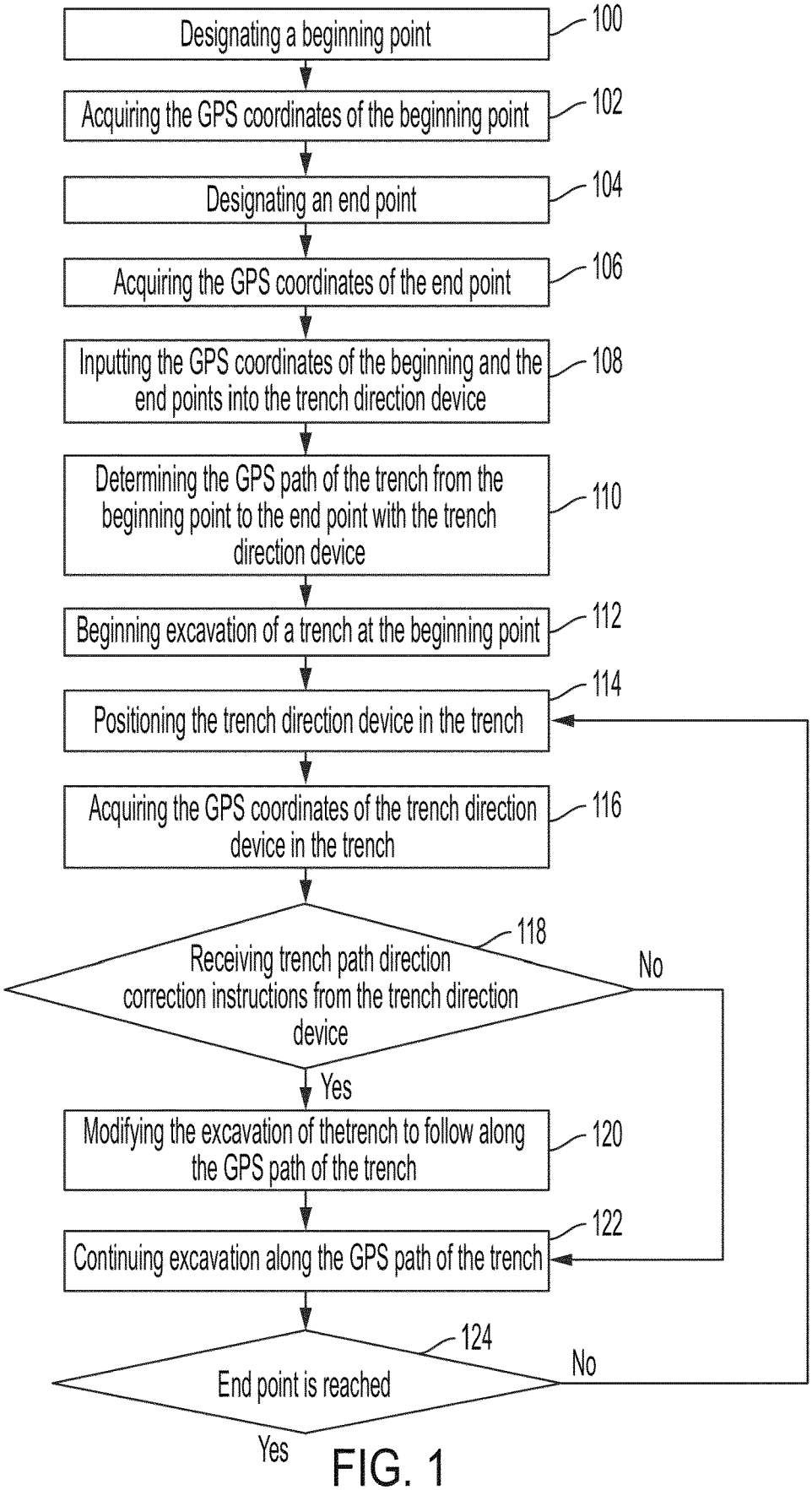
FIG. 1 illustrates, in a flowchart, operations for excavating a trench using a GPS-guided device in accordance with certain embodiments.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The present teachings are directed to a device for maintaining the excavation of a trench along a predetermined path. The device comprises a GPS receiver, a control module, a rewritable memory, a touch screen, and a direction correction display. The control module determines whether GPS coordinates received from the GPS receiver deviate from a predetermined line and generates a direction correction signal for displaying on the direction correction display.

The GPS receiver, which could be a real-time kinematics (RTK) board, a differential GPS receiver, or a space-based GPS receiver, performs data reception tasks. It receives GPS coordinates, which serve as position data, and sends these coordinates to the control module. The GPS receiver also acquires signals from the Global Navigation Satellite System (GNSS), along with a correction stream, to provide a near centimeter level of positional accuracy. This high-precision positioning task is crucial for maintaining the excavation of the trench along the predetermined path.

The control module, which could be a microcontroller, a digital signal processor, or a Raspberry Pi, performs control and data-processing tasks. It recognizes the data inputted through the touch screen, received from the GPS receiver, and the rewritable memory. The control module then performs the operation of determining the variance between the predetermined line and the current location of the device, and outputs a location correction signal to the correction display. This process of data recognition, comparison, and output generates the direction correction signal.

The rewritable memory, which could be a flash memory, an electrically erasable programmable read-only memory, or a magnetoresistive RAM, performs data storage tasks. It stores the initial surveyor provided GPS coordinates received from the touch screen, which are then used by the control module for determining the variance between the predetermined line and the current location of the device.

The touch screen, which could be a capacitive touchscreen, a resistive touchscreen, or an infrared touchscreen, serves as a data input and output medium. It receives user interaction and sends data to the control module. When a request direction button on the touch screen is activated, the control module generates a direction correction signal.

The direction correction display, which can be incorporated as a part of the touch screen, can, in some embodiments be an LED display, an LCD display, or a plasma display, presents the direction correction signal. This visual signal guides the user in maintaining the excavation of the trench along the predetermined path.

The presently disclosed device is intended to be a lower cost alternative to more costly GPS devices with more features and capabilities. The present device provides a means to maintain adherence to a path as measured by GPS in a simple straightforward manner without the need for extensive training to correctly operate the device. The present device is also of durable construction to withstand the rigors of the environment of a trench excavation operation with associated mechanical shocks, high moisture, and temperature extremes.

In summary, the present teachings provide a device for maintaining the excavation of a trench along a predetermined path. The device uses a GPS receiver to receive GPS coordinates, a control module to process the data and generate a direction correction signal, a rewritable memory to store the GPS coordinates, a touch screen to input data and activate the direction correction signal, and a direction correction display to present the direction correction signal. The presently disclosed device ensures that the trench is excavated accurately along the predetermined path.

Also disclosed by the present teachings is a process which begins with the designation of start and end points for the trench. This task can be achieved by a professional surveyor, and then the GPS coordinates of these points can be determined. In some embodiments, the presently taught device can be positioned at the start and end points and the GPS coordinates can be received from the GPS system, and recorded in the presently disclosed trench excavation guidance device, and in other embodiments the GPS coordinates can be manually entered into the trench excavation guidance device through its touch screen or other appropriate data entry method.

The presently disclosed process can also include positioning conduit in the trench. The conduit can include, for example, pipes transporting one or more of fluids, gases and solids, and mixtures thereof, and wires or fibers carrying signals.

Once the start and end points have been established and their GPS coordinates inputted into the trench excavation guidance device, the coordinates can be used to determine the GPS path of the trench from the start point to the end point.

The excavation of the trench then begins at the start point. As the trench is being dug, the trench excavation guidance device is positioned in the trench. The GPS Receiver of the trench excavation guidance device can then be used to acquire the GPS coordinates of the trench excavation guidance device in the trench. The trench excavation guidance device then determines the trench path direction correction instructions. These instructions could be visual signals or audible alerts that guide the excavation process to ensure that the trench follows the predetermined GPS path.

The excavation continues along the GPS path of the trench. In some embodiments, the presently disclosed trench excavation guidance can continuously receive GPS location information, and if the trench deviates from the GPS path, the device can emit a direction correction signal to notify an operator that the excavation path needs correction. In other embodiments, the trench excavation guidance device only acquires GPS coordinates when a request is entered into the device through a menu screen on the display screen or through a request button, either digital on a screen, or a physical button on the device, receiving direction correction instructions, and modifying the excavation process is repeated until the end point is reached.

In other embodiments, the present process can be utilized to maintain adherence to any predetermined path with GPS coordinates entered into the presently disclosed device and is not limited to trench excavations.

The presently disclosed process is further detailed in FIG. 1, as starting with step 100, the process begins by identifying a starting point for the excavation. This could be done by a land surveyor, a geodetic surveyor, or a topographic surveyor, who would use their professional expertise to determine the most suitable location for the start of the trench. They would take into account factors such as the terrain, the intended direction of the trench, and any potential obstacles. Once the starting point has been identified, it is marked in some way, such as with a stake or a flag, to ensure it can be easily found again.

Over time, the path markings, either flags or paint, used by the surveyors to mark the start and end points, and the run of the path can be erased, no longer clearly discernible, or moved. The presently disclosed device and method eliminate the need for a costly return visit by the surveyors to remark the path thus avoiding extra costs and also time delays.

In step 102, the GPS coordinates of the starting point are acquired. This could be done using a GPS Receiver such as the presently disclosed trench excavation guidance device. These devices use signals from satellites to accurately determine the geographical location of the starting point. The coordinates are usually given in terms of latitude and longitude, but other systems such as UTM (Universal Transverse Mercator) coordinates or MGRS (Military Grid Reference System) coordinates could also be used. The GPS receiver records these coordinates for later use.

Step 104 involves designating an end point for the trench. This is done in a similar way to the starting point, with a surveyor choosing the most appropriate location based on the intended direction and length of the trench, and any potential obstacles. The end point is also marked for easy identification.

In step 106, the GPS coordinates of the end point are acquired. This is done in the same way as for the starting point, using a GPS receiver or the presently disclosed trench excavation guidance device to record the exact geographical location of the end point.

Step 108 involves inputting the GPS coordinates of the starting and end points into the trench excavation guidance device, if not already inputted in the above steps. The presently disclosed device can use the inputted GPS coordinates of the start and end points to calculate the intended direction of the trench. The coordinates can be inputted via a user interface, such as a touch screen or a keypad.

In step 110, the GPS path of the trench from the starting point to the end point is determined. This is done by the trench excavation guidance device, which uses the inputted GPS coordinates to calculate the most direct route between the two points. This path is then stored in the device's memory for later use.

Step 112 involves beginning the excavation of the trench at the starting point. This could be done using a variety of tools or machinery, depending on the size and depth of the trench. The excavation follows the path calculated by the trench excavation guidance device.

In step 114, the trench excavation guidance device is positioned in the trench with the GPS transmitter portion positioned and ready to receive GPS data. The device uses its GPS receiver to either constantly, or upon activation of the GPS receiver by a user to monitor its position in relation to the intended path of the trench.

Step 116 involves acquiring the GPS coordinates of the trench excavation guidance device in the trench. This is done by requesting acquisition of the GPS coordinates by touch activation of the device's touch screen menu, or by activating a separate button on the device. The device's GPS receiver receives and records its current geographical location.

In step 118, trench path direction correction instructions are received from the trench excavation guidance device. These instructions are generated by the device based on the difference between its current position and the intended path of the trench. The instructions could be a visual signal on the device's display such as an arrow or a series of lights, an auditory signal, or a tactile signal such as a vibration. If no correction is needed, then step 120 is skipped, and the next step in this disclosed process is step 122.

Step 120 involves modifying the excavation of the trench to follow along the GPS path. This could involve adjusting the direction of the excavation, and in some embodiments of the present teachings, the depth or width of the trench. The modifications are made based on the direction correction instructions received from the trench excavation guidance device.

In step 122, the excavation continues along the GPS path of the trench. This involves continuing to dig the trench in the direction indicated by the trench excavation guidance device. The device continues to monitor its position and can provide direction correction instructions as needed, or as requested by an operator.

Finally, in step 124, steps 114 to 122 are repeated until the end point is reached. This involves either continuously monitoring the position of the trench excavation guidance device, or requesting position information as needed, receiving direction correction instructions, and adjusting the excavation as necessary. The process continues until the trench has been dug from the starting point to the end point.

In some embodiments of the presently disclosed process, during an excavation when the initial end point is not reached at the end of the workday or shift, or at any time during an excavation, the presently disclosed device can acquire the GPS coordinates of most recently excavated position in the trench on the predetermined line. Those GPS coordinates can then replace in the rewritable memory the GPS coordinates of the starting point and can be used in subsequent position determinations as a new or second starting point.

Throughout the process, various metrics may be measured and monitored. These could include the depth and width of the trench, the speed of excavation, the accuracy of the GPS coordinates, and the effectiveness of the direction correction instructions. These metrics can be used to evaluate the performance of the device and make necessary adjustments to improve efficiency and accuracy.

Figure 2:
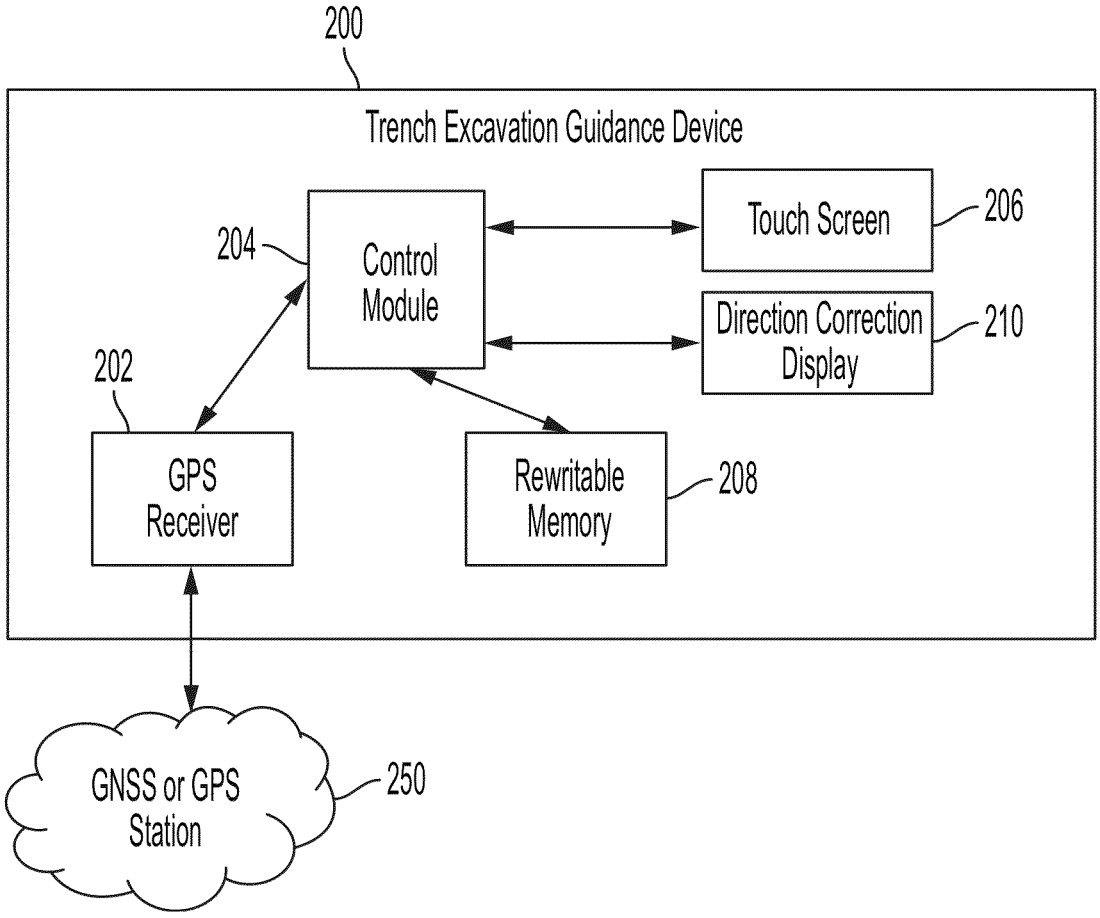
FIG. 2 illustrates, in a block diagram, a device for maintaining the excavation of a trench along a predetermined path in accordance with certain embodiments.

The presently disclosed trench excavation guidance device 200 contains various components as illustrated in FIG. 2 including a GPS Receiver 202, a control module 204, a touch screen 206, a rewritable memory 208, a direction correction display 210, also illustrated is the outside GPS station or GNSS 250 which provides GPS signals to the device.

The GPS receiver 202 receives GPS signals from GPS providers such as base stations or satellites and converts them into GPS coordinates. These coordinates are used to determine the geographical location of the start and end points of the trench, as well as the current location of the trench excavation guidance device. The accuracy of the GPS coordinates is crucial for the successful execution of the trench excavation process.

The control module 204 receives the GPS coordinates from the GPS receiver 202 and determines whether they deviate from a predetermined line. If a deviation is detected, the control module generates a direction correction signal which is sent to the direction correction display 210. The direction correction signal is used to guide the excavation process and ensure that the trench follows the predetermined path. The control module also controls the operation of the other components of the device, including the rewritable memories 208, touch screen 206, and direction correction display 210.

The rewritable memory 208 stores the GPS coordinates of the start and end points, as well as the current location of the trench excavation guidance device. This information is used by the control module 204 to determine the GPS path of the trench and generate the direction correction signal.

The touch screen 206 serves as an interface between the user and the device. The user can input the GPS coordinates of the start and end points through the touch screens. The touch screens also display information to the user, including the direction correction display 210. In some embodiments, the touch screen can include the direction correction display, and in others the two are separate displays. In either case, the direction correction displays 210 receive the direction correction signal from the control module and display it to the user. This visual signal guides the user in adjusting the excavation process to follow the GPS path of the trench.

In summary, each component of the device plays a role in maintaining the excavation of a trench along a predetermined path.

Figure 3:
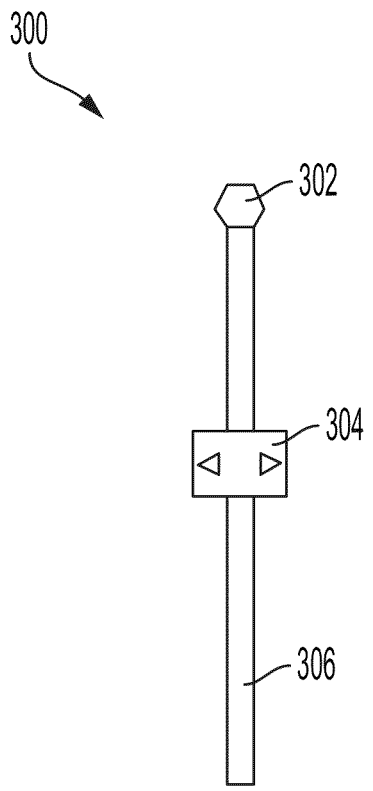
FIG. 3. is a plan view of one embodiment of the presently disclosed device, and FIG. 4. is a magnification of the control box of FIG. 3.
Figure 4:
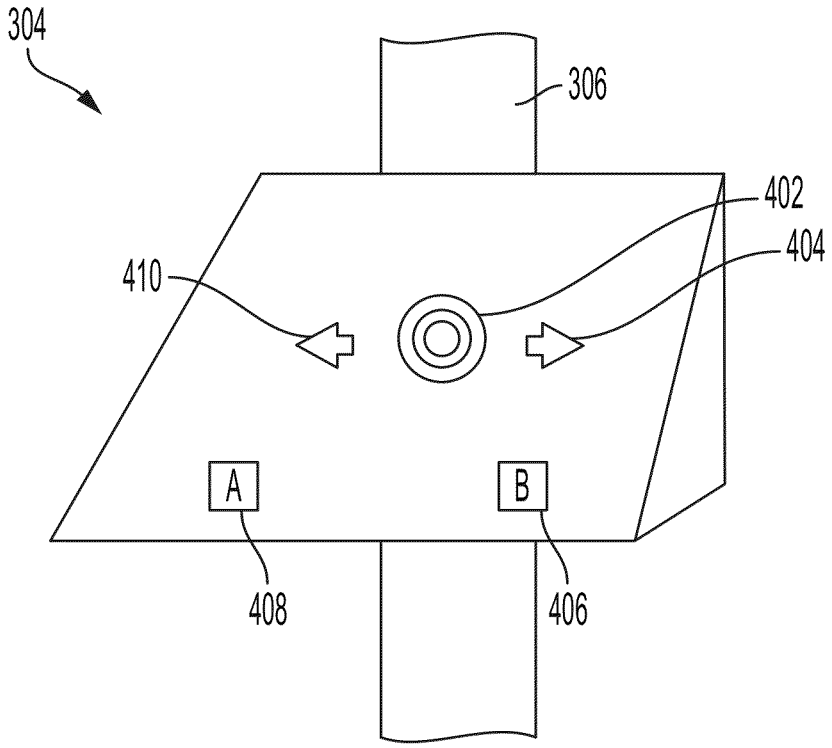

One embodiment of the presently disclosed device is illustrated in FIGS. 3 and 4 with FIG. 4 providing more detail of the control box 304. The presently disclosed device 300 includes a GPS transmitter/receiver 302 mounted on the top of a support rod 306 with a control box 304 mounted further down on the support rod 306. The control box 304 is electronically connected to the GPS transmitter/receiver 302 and houses internally the control module 204, rewritable memory 208, and can have a touchscreen 206 configured to display the direction lights 402, 404, 410, and information on the starting A and end points B, 406 and 408. The actual colors of the lights 402, 404, and 410 can be varied as desired.

Another embodiment of the presently disclosed device uses a combination of non-touchscreen direction lights 402, 404 and 410, and a touchscreen for entry and display of the GPS way point data. In some embodiments, the direction light 402 can also be a button to activate the acquisition of GPS data and the subsequent determination of the needed correction to maintain the correct path.

The present teachings may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as SMALLTALK, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Reference in the specification to "one embodiment" or "an embodiment" of the present invention, as well as other variations thereof, means that a feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

Having described preferred embodiments of a system and method (which are intended to be illustrative and not limiting), it is noted that modifications and variations can be made by persons skilled in the art considering the above teachings. It is therefore to be understood that changes may be made in the embodiments disclosed which are within the scope of the invention as outlined by the appended claims. Having thus described aspects of the invention, with the details and particularity required by the patent laws, what is claimed and desired protected by Letters Patent is set forth in the appended claims.

I claim:

1. A stand-alone device for maintaining a predefined path for an excavation trench, the stand-alone device comprising:

one or more GPS receivers;

one or more control units;

one or more storage units;

one or more user interfaces; and one or more direction guidance displays;

wherein the control unit determines whether positioning coordinates received from the GPS receiver deviate from a predefined path for an excavation trench and transmits a path correction signal to the direction guidance display to produce a sound and/or light-based signal indicating any correction needed to maintain the predetermined path for an excavation trench, wherein the path correction signal comprises directional indicators displayed on the direction guidance display that audibly and/or visually indicate a direction of correction, wherein the stand-alone device does not communicate with any excavation machine, and the predefined path comprises a start point and an end point that are too distant to be visible with a naked eye from a location where the GPS receiver receives positioning coordinates.

2. The stand-alone device of claim 1, wherein the path correction signal is generated when a user input element on the user interface is activated.

3. The stand-alone device of claim 1, wherein the stand-alone device receives the positioning coordinates of a start point and an end point of the predefined path through the user interface and stores them in the storage unit.

4. The stand-alone device of claim 1, wherein the control unit is implemented by one or more computing units.

5. The stand-alone device of claim 4, wherein the computing unit recognizes information inputted through the user interface, received from the positioning system receiver and the storage unit, performs an operation of determining a variance between the predefined path and current location of the device, and outputs a path correction signal to the direction guidance display.

6. The stand-alone device of claim 1, wherein the positioning system receiver is a high-precision positioning board which acquires signals from one or more satellite positioning systems, along with accuracy enhancement data, to provide a high level of positional accuracy.

7. The stand-alone device of claim 6, wherein the positioning system receiver connects to one or more internet-based correction data servers.

8. The stand-alone device of claim 6, wherein the positioning system receiver receives a high-accuracy positioning signal which can have an accuracy of up to 20 cm.

9. The stand-alone device of claim 6, wherein the positioning system receiver receives an ultra-high-accuracy positioning signal which can have an accuracy of 1 cm when located in an open area.

10. A method for excavating an excavation path, the method comprising:

a. providing a stand-alone excavation guidance device which i. acquires positioning coordinates of a start point;

ii. acquires positioning coordinates of an endpoint;

iii. determines a path of excavation from the start point to the end point;

iv. acquires its positioning coordinates when it is positioned in an excavation site;

v. determines any correction needed to maintain the path of the excavation; and iv. outputs a sound and/or light-based signal that indicates any correction needed to maintain the path of the excavation, wherein the sound and/or light-based signal comprises directional indicators that audibly and/or visually indicate a direction of correction;

b. excavating an excavation site at the start point;

C. positioning the stand-alone excavation guidance device in the excavation site;

d. excavating the path of the excavation according to the sound and/or light-based signal displayed on the stand-alone excavation guidance device;

e. modifying, in response to the sound and/or light-based signal, the excavation to follow along the path of the excavation;

f. continuing excavation along the path of the excavation, and h. repeating steps c. through f. until the end point is reached, wherein the excavation path comprises a trench having a start point and an end point that are too distant to be visible with a naked eye from the excavation site during the acquisition of the positioning coordinates by the stand-alone excavation guidance device.

11. The method of claim 10, wherein a transport medium comprises tubular transport systems transporting one or more of liquid materials, gaseous materials and solid materials, and mixtures thereof, and conductive elements or transmission elements carrying light-based signals or electricity-based signals.

12. The method of claim 10, wherein the excavation path correction instructions comprise a visible indicator on the stand-alone excavation guidance device.

13. The method of claim 10, wherein the stand-alone excavation guidance device comprises a positioning system receiver, a control unit, a storage unit, a user interface, and a direction guidance display.

14. The method of claim 10, wherein the control unit determines whether positioning coordinates received from the positioning system receiver deviate from a predefined path and generates a path correction signal for displaying on the direction guidance display.

15. The method of claim 10, wherein the path correction signal is generated when a user input element on the user interface is activated.

16. The method of claim 10, wherein the stand-alone excavation guidance device receives the positioning coordinates of the start point and the end point of the predefined path through the user interface and stores them in the storage unit.

17. The method of claim 10, wherein the control unit is implemented by one or more computing units.

18. The method of claim 10, wherein the computing unit recognizes information inputted through the user interface, received from the positioning system receiver and the storage unit, performs an operation of determining a variance between the predefined path and current location of the stand-alone excavation guidance device, and outputs a position correction signal to the direction guidance display.

19. The method of claim 10, wherein the positioning system receiver is a high-precision positioning board which acquires signals from one or more satellite positioning systems, along with accuracy enhancement data, to provide a high level of positional accuracy.

20. A stand-alone device for maintaining a predefined path for an excavation trench, the stand-alone device comprising:

one or more GPS receivers;

one or more control units;

one or more storage units;

one or more user interfaces; and one or more direction guidance displays;

wherein the stand-alone device is separate and apart from an excavation machine, wherein the stand-alone device does not communicate with the excavation machine or its control system, wherein the control unit determines whether positioning coordinates received from the GPS receiver deviate from a predefined path for the excavation trench and transmits a path correction signal to the direction guidance display to produce a sound and/or light-based signal indicating any correction needed to maintain the predetermined path for the excavation trench, and wherein the path correction signal comprises directional indicators displayed on the direction guidance display that audibly and/or visually indicate a direction of correction.

21. The device according to claim 20, wherein the predefined path comprises a start point and an end point that are too distant to be visible with a naked eye from a location where the GPS receiver receives positioning coordinates.

* * * * *